US005417327A

United States Patent [19]

Saumure

[11] Patent Number: 5,417,327

[45] Date of Patent: May 23, 1995

[54] INSULATED MODULAR VESSEL FOR TRANSPORTING BEVERAGE CONTAINERS

[76] Inventor: Denis A. Saumure, Merrickville, Ontario, Canada, K0G 1N0

[21] Appl. No.: 190,455

[22] Filed: Feb. 2, 1994

[51] Int. Cl.[6] ..... A47J 41/00; B65D 81/38

[52] U.S. Cl. ..... 206/427; 206/428; 206/430; 220/23.83; 220/411; 215/13.1

[58] Field of Search ..... 206/427, 430, 428; 220/23.83, 411; 215/13.1

[56] References Cited

U.S. PATENT DOCUMENTS

| | | | |
|---|---|---|---|
| 1,975,428 | 10/1934 | John | 206/430 |
| 2,345,887 | 4/1944 | Rothrock . | |
| 3,013,492 | 12/1961 | Sexton | 220/23.83 |
| 3,263,806 | 8/1966 | Ring | 206/427 |
| 4,119,248 | 10/1978 | Butler et al. | 206/203 X |
| 4,228,908 | 10/1980 | Tweeton | 220/23.83 |
| 4,383,422 | 5/1983 | Gordon et al. | 215/13.1 |
| 4,444,324 | 4/1984 | Grenell | 215/13.1 |

FOREIGN PATENT DOCUMENTS

| | | | |
|---|---|---|---|
| 1116567 | 1/1982 | Canada | 206/430 |
| 1234375 | 3/1988 | Canada . | |
| 2249717 | 5/1992 | United Kingdom | 206/428 |
| 9012529 | 11/1990 | WIPO | 215/13.1 |

OTHER PUBLICATIONS

"Novelties", Advertisement for KOOLTUBE TM, Date unavailable.

Advertisement for TWOCAN TM, Date unavailable.

*Primary Examiner*—William I. Price

*Attorney, Agent, or Firm*—Donald E. Hewson

[57] ABSTRACT

An insulated modular vessel for transporting beverage containers of a known size and shape, typically cans and bottles, is disclosed. The insulated modular vessel comprises at least one main body portion having first and second open ends and generally cylindrically shaped peripherally disposed outer wall extending between the first and second ends so as to define a centrally disposed cavity shaped and dimensioned to receive and retainer beverage containers therein. An insulating layer is disposed generally around the perimeter of the main body portion. The first and second open ends are shaped and dimensioned to permit the passage of beverage therethrough into and out of the centrally disposed cavity. Co-operating male and female threads are disposed at the first and second ends respectively of the main body portion so as to permit a plurality of main body portions to be removably matably attachable to one another in first-end-to-second-end relation so as to form the modular vessel. First and second threaded end caps are removably matably attachable to the first and second ends of the main body portions to thereby close off the open ends of the formed modular vessel. The second end cap may be permanently attached as a second end closure to permit each main body portion to potentially be used to retain a beverage container while consuming the beverage therefrom.

16 Claims, 4 Drawing Sheets

INSULATED MODULAR VESSEL FOR TRANSPORTING BEVERAGE CONTAINERS

FIELD OF THE INVENTION

This invention relates to insulated vessels for transporting beverage containers such as cans, and more particularly to small size readily carriable insulated vessels for carrying such beverage containers.

BACKGROUND OF THE INVENTION

Keeping beverages cold while in a home is typically accomplished in modem society through the use of refrigerators, that provide a controlled climate in which virtually any size, shape, or type of beverage container may be refrigerated to a desired temperature. However, it is often necessary, or at least desirable, to take such beverages from one's home and transport them for consumption at a remote location, such as on a picnic, playing sports, hiking, and so on. Once removed from the refrigerator, however, the beverages in these beverage containers no longer remain cold. Typically, within a short period of time, perhaps as little as an hour or so in extremely hot weather conditions, these beverages become warmer and are no longer at an ideal temperature for consuming. It is obviously desirable to keep such beverages at a cold temperature much longer than a couple of hours after being removed from a refrigerator.

For many years, keeping beverages cold once removed from a refrigerator has been accomplished through the use of an insulated single compartment beverage container commonly referred to as an insulated jug, which receives and retains a quantity of liquid beverage therein. This type of container typically uses a material such as foam, or even uses a structure that has a vacuum between two co-operating spaced apart walls, to provide the required insulative properties. An insulated lid is removably secured over the mouth of the insulated jug, in sealed relation at the top thereof. One such type of insulated jug is sold under the brand name THERMOS ®.

Insulated jugs tend to have various limitations, however. Firstly, their size is usually limited to about perhaps 10–20 gallons. Further, the larger of these insulated jugs are difficult to handle and use, especially when full. Another fundamental problem is that they are not ideal for carrying carbonated beverages and the like, which are necessarily stored in sealed cans or bottles—typically less than about 2 litres in volume—so that any carbonation or any other gas contained in solution is not lost through reduction in partial pressure within the container after opening of the container. Further, these types of containers are obviously not meant for, and are indeed not suitable for, transporting the cans or bottles that contain beverages.

In order to transport and generally store cans or bottles containing beverages, various types of coolers are available. Such coolers come in many different sizes, from small ones that hold maximally perhaps six or twelve to very large coolers that hold perhaps about two hundred cans. These coolers also vary as to the materials they are constructed of and also as to the price. Some types of these coolers may be powered by way of electricity or propane so as to maintain a relatively constant internal temperature. However, most coolers are merely unpowered, insulated vessels that, in use, contain beverage containers packed in quantities of ice to keep the beverage containers cold. It is also quite inconvenient to keep empty cans or bottles in a cooler since they tend to get in the way when one is trying to find a full can or bottle.

The problem with such coolers is that even the smallest one is not very versatile in terms of portability and would typically need to be carried either by hand or within a large picnic basket or large carrying bag. They cannot readily be transported and generally carried by a person by way of being strapped to a person's torso—such as a hip saddle might be—and further, they cannot be readily carried in various types of carrying bags that might be used during leisure activities such as sports, picnics, hiking, and so on.

One such portable beverage container carrier is known and is sold under the name of TWOCAN TM, which is touted as a "personal canteen". This carrier contains two cans in side-by-side relation only and is in the form of a case that is very similar in size and shape to a binocular case. A carrying strap is configured for wearing across a person's shoulder so that this vessel may be carried at, or slightly above, hip height. This carrying case has various limitations, however. It is not adaptable in terms of how it carries or in terms of the number of cans it carries. It can only carry one or two cans—and indeed is unbalanced if it carries only one can. Further, it is of a shape that will not allow it to readily fit into narrow carrying bags such as golf bags, and the like.

Another type of insulated vessel used in conjunction with beverage containers such as cans and bottles is one that contains a single can or bottle while the beverage therein is being consumed. This type of container typically also has an internal layer of material, which is typically a suitable gel or similar, that does not readily absorb or transmit heat. In use, such a container is put into the freezer until this material reaches a very cold temperature and, in use, any heat from the ambient surroundings must first pass through a layer of insulation, then must be absorbed into this material, and then must be transmitted to the can or bottle contained therein. Resultingly, these containers tend to keep a single can or bottle reasonably cold for perhaps several hours. These types of beverage containers are not for use in transporting cans or bottles, however, as they have an open top end—there is no top cap or lid to attach thereto. Further, they each only hold one can or bottle and are not connectable one to the other in an aggregate manner so as to be configured to retain several cans or bottles. One such single drinking container as previously described is marketed under the name THE FRIDGE, and is taught in Canadian Patent No. 1,234,375.

None of the above insulated carrying vessels provides for conveniently carrying a small number of cans or bottles—perhaps two through twenty-four—in a convenient and adaptable manner so as to fit into any type of carrying container—even very long and narrow containers such as a golf bag—so as to be fully insulated during transportation.

Also, none of the above insulated carrying vessels provides a way for empty cans or bottles to be reinserted into the carrying vessel so as to not generally interfere with the removal of the other full cans or bottles.

Further, none of the above prior art insulated vessels provides for both carrying of cans and bottles during transportation and also a vessel that allows for holding of the can or bottle so as to keep it cold while consuming the beverage therein.

SUMMARY OF THE INVENTION

In accordance with one aspect of the present invention, there is provided an insulated modular vessel for transporting beverage containers that are of a known size and shape. The modular vessel comprises at least one main body portion having a first end, a second end, and a generally cylindrically shaped peripherally disposed outer wall extending between the first and second ends and defining a centrally disposed cavity shaped and dimensioned to receive and retain at least one of the beverage containers therein. There are first and second openings in the main body portion at the first and second ends thereof respectively, the first and second openings each being shaped and dimensioned to permit the passage of the at least one beverage container therethrough, into and out of the centrally disposed cavity. First and second matable interconnection components are disposed at the first and second ends respectively of the main body portion such that a plurality of the main body portions are removably matably attachable one to another in first end to second end relation so as to form the modular vessel. There are first and second end caps each having one of the second and first interconnection components thereon respectively, so as to be removably matably attachable to the first and second interconnection components respectively to thereby close off the open ends of the formed modular vessel.

In accordance with another aspect of the present invention, there is provided an insulated modular vessel for transporting beverage containers that are of a known size and shape. The modular vessel comprises at least one main body portion having a first end, a second end, and a generally cylindrically shaped peripherally disposed outer wall extending between the first and second ends and defining a centrally disposed cavity shaped and dimensioned to receive and retain at least one of the beverage containers therein. There is a first opening in the main body portion at the first end thereof, with the first opening being shaped and dimensioned to permit the passage of the at least one beverage container into and out of the centrally disposed cavity. A second end closure is attached to the main body portion at the second end thereof so as to preclude the passage of the beverage containers into and out of the modular vessel. First and second matable interconnection components disposed at the first and second ends respectively of the main body portion such that a plurality of the main body portions are removably matably attachable one to another in first end to second end relation so as to form the modular vessel. A first end cap having the second interconnection component thereon, is removably matably attachable to the first interconnection component to thereby close off the open end of the formed modular vessel.

In accordance with yet another aspect of the present invention, there is provided an insulated modular vessel for transporting beverage containers that are of a known size and shape. The modular vessel comprises two main body portions each having a first end, a second end, and a generally cylindrically shaped peripherally disposed outer wall extending between the first and second ends and defining a centrally disposed cavity shaped and dimensioned to receive and retain at least one of the beverage containers therein. There is a first opening in the main body portion at the first end thereof, the first opening being shaped and dimensioned to permit the passage of the at least one beverage container into and out of the centrally disposed cavity. A second end closure is attached to the main body portion at the second end thereof so as to preclude the passage of the beverage containers into and out of the modular vessel. First and second matable interconnection components are disposed at the first ends respectively of the main body portion such that the two main body portions are removably matably attachable to each other in first end to first end relation so as to form the modular vessel. The modular vessel is closed off by the two of the second end closures.

BRIEF DESCRIPTION OF THE DRAWINGS

Embodiments of this invention will now be described by way of example in association with the accompanying drawings in which.

DETAILED DESCRIPTION OF THE PREFERRED EMBODIMENTS

Figure 1:
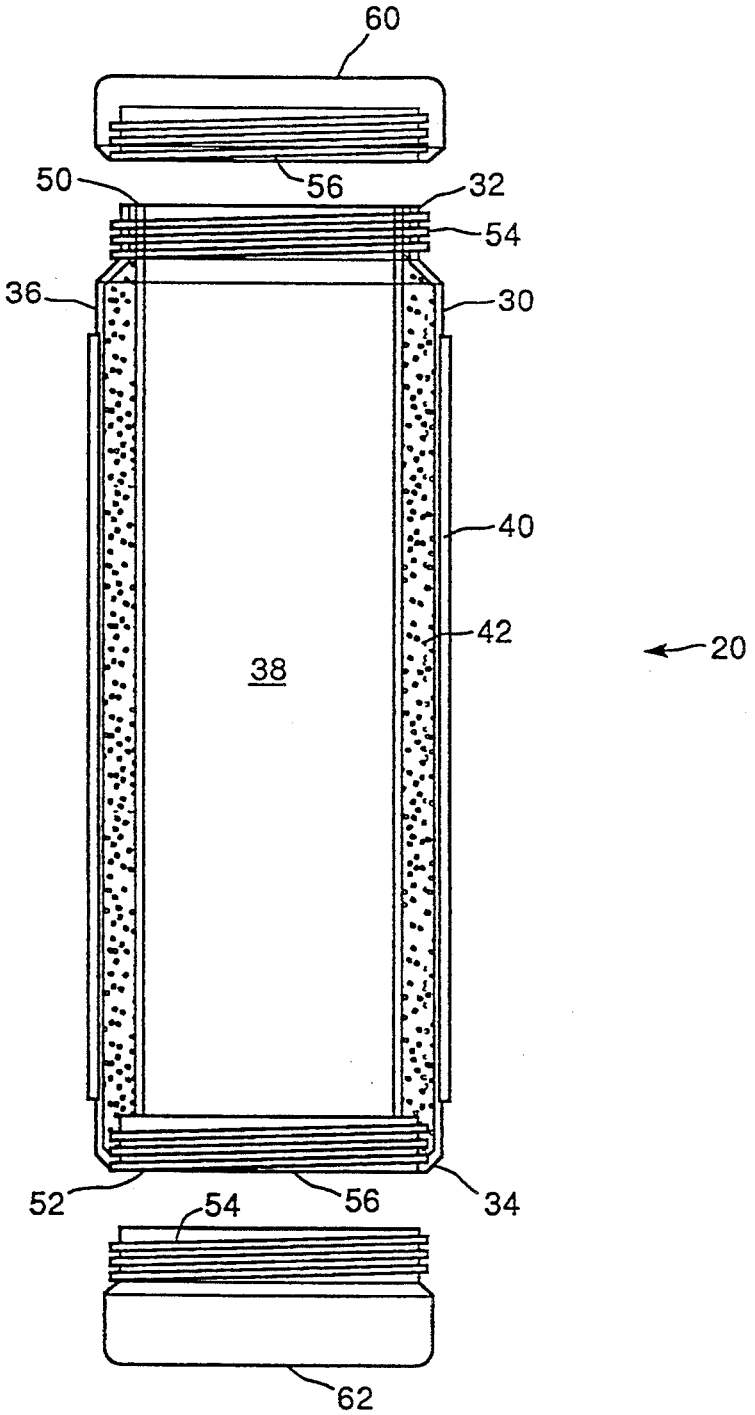
FIG. 1 is an exploded diagrammatic side elevational view of the insulated modular vessel of the present invention.
Figure 2:
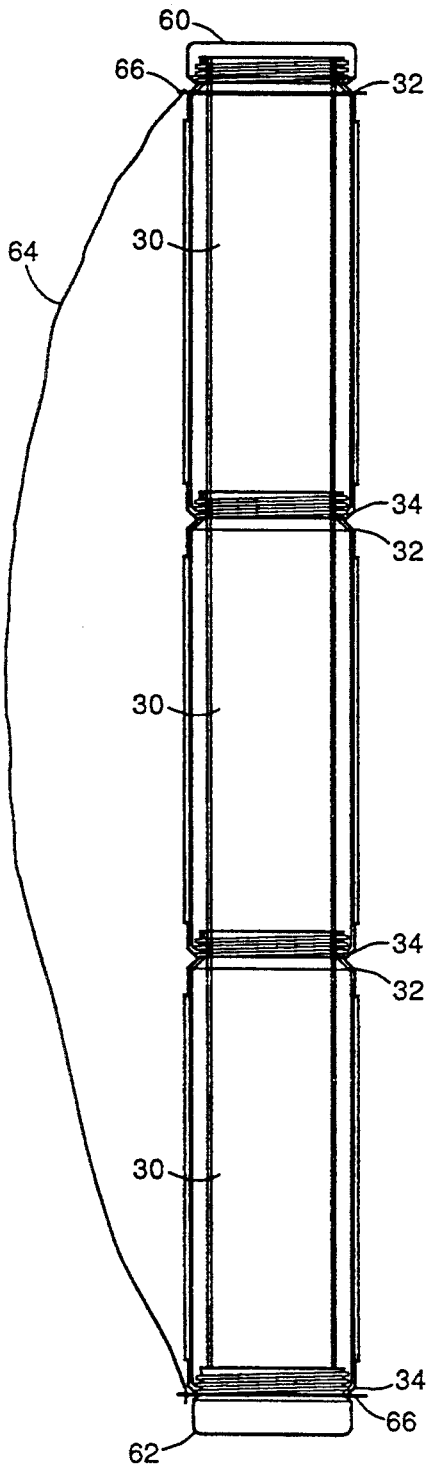
FIG. 2 is a diagrammatic side elevational view on a reduced scale of the insulated modular vessel of the present invention wherein three main body portions are connected one to another in end-to-end relation.
Figure 3:
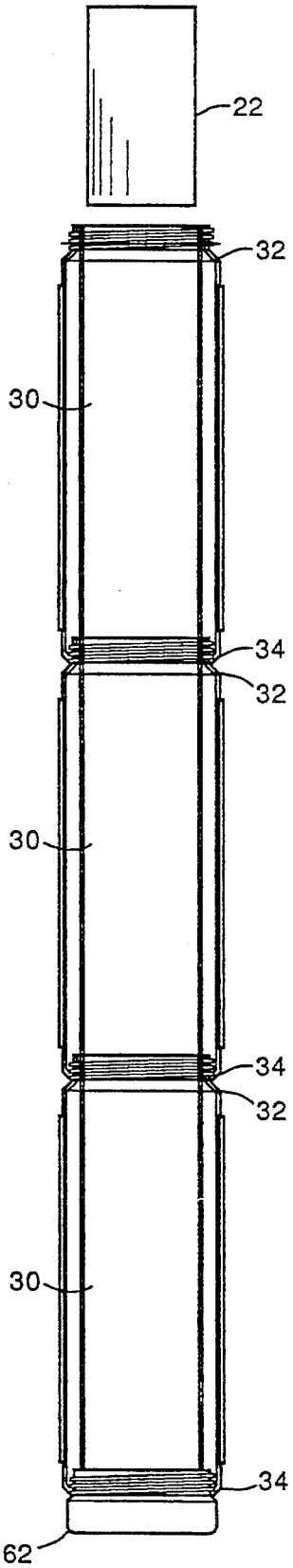
FIG. 3 is a diagrammatic side elevational view similar to FIG. 3, with an end cap remove and a beverage container about to be inserted.

Reference will now be made to FIGS. 1 through 3, which show the insulated modular vessel 20 of the present invention, as indicated by the general reference numeral 20, that is used for transporting beverage containers, such as cans 22 and bottles, of a known shape and size. This preferred embodiment as shown, is shaped and sized to receive and retain standard size beverage cans, such as the can 22 shown in FIG. 3. In the detailed description, the term "cans" will therefore be used when referring to a beverage containers. It shall be understood that the insulated modular vessel 20 of the present invention is equally able to receive bottles of a suitable size.

The modular vessel 20 comprises at least one main body portion 30, with each main body portion 30 having a first end 32, a second end 34, and a generally cylindrically shaped peripherally disposed outer wall 36 extending between the first and second ends 32,34. The peripherally disposed outer wall 36 defines a centrally disposed cavity 38 that is shaped and dimensioned to receive and retain two cans therein. There is also supplementary thermal insulation means 40 operatively retained by the modular vessel 20 so as to be disposed generally around the perimeter thereof. This insulation means 40 may be either disposed externally, as shown, or disposed internally of the outer wall 36. Further, a heat-absorbing medium in the form of a layer of gel 42, or other freezable liquid, is preferably disposed generally around the inside of the perimeter of the outer wall 36 so as to border and generally define the centrally disposed cavity 38. In use, this gel 42 is chilled or frozen and thereby absorbs heat from the ambient surroundings before this heat reaches the cans 22 retained within the insulated modular vessel 20.

There is a first opening 50 in the main body portion 30 at the first end 32 thereof and a second opening 52 in the main body portion 30 at the second end 34 thereof. The first and second openings 52,54 are each shaped and dimensioned to permit the passage of the can 22 therethrough, into and out of the centrally disposed cavity 38.

Also disposed at the first and second ends 32,34 respectively of the main body portion 30 are first and second matable interconnection components. The first interconnection component is preferably a male thread 54 and the second interconnection component is preferably a co-operating female thread 56, with each of the male and female threads 54,56 being moulded as an integral part of the main body portion 30. Any two main body portions 30 are removably matably attachable one to the other by threadible engagement of the first end 32 of one main body portion 30 with a second end 34 of another main body portion 30. In this manner, a plurality of main body portions 30 may be connected one to another in end-to-end relation so as to form an elongated insulated modular vessel 20, as is shown in FIG. 2, which may be ideal for carrying in a long slender carrying case, such as a golf bag.

A first end cap 60 having the second interconnection component thereon, also in the form of the female thread 56, is removably matably attachable to the first end 32 of other main body portion 30. A second end cap 62 has the first interconnection component thereon in the form of the male thread 54 is removably matably attachable to the second end 34 of other main body portion 30. The first and second end caps 60,62 thereby close off the open ends of the one or more main body portions 30, as appropriate, when in place on the respective first and second ends 32,34 thereof, so as to form a complete insulated modular vessel 20.

A conventional carrying strap 64 is connected to the insulated modular vessel 20 at the opposite ends thereof by way of a pair of strap connecting members 66. One strap connecting member 66 is located between the first end 32 of the top (as shown) main body portion 30 and the first end cap 60, while the other strap connecting member 66 is located between the second end 34 of the bottom (as shown) main body portion 30 and the second end cap 62. It can be seen that the carrying strap 64 can connect to the insulated modular vessel 20 virtually no matter how many main body portions are present, and also may be connected between any two adjacent main body portions or end caps.

In use, the insulated modular vessel 20 as shown in FIG. 1, contains two of the cans 22 (not shown in FIG. 1) in end-to-end relation. In order to insert cans 22, the first end cap 60 is removed from the first end 32 of the uppermost main body portion 30. An appropriate number of cans 22 may then be inserted one at a time through the open first end 32. The first end cap 60 is then replaced on the open first end 32. In order to subsequently access the cans that are retained within the insulated modular vessel 20, the first end cap 60 is again removed and then replaced after the desired cans 22 have been removed therefrom. It is also possible to reinsert empty cans 22 into the insulated modular vessel 20, preferably by removing the second end cap 62. In this manner, empty cans 22 do not have to be immediately disposed of. It should be understood that the insertion and removal of both the full and empty cans 22 can be done at either of the first and second ends 32,34 of the insulated modular vessel 20, as is convenient.

Figure 4:
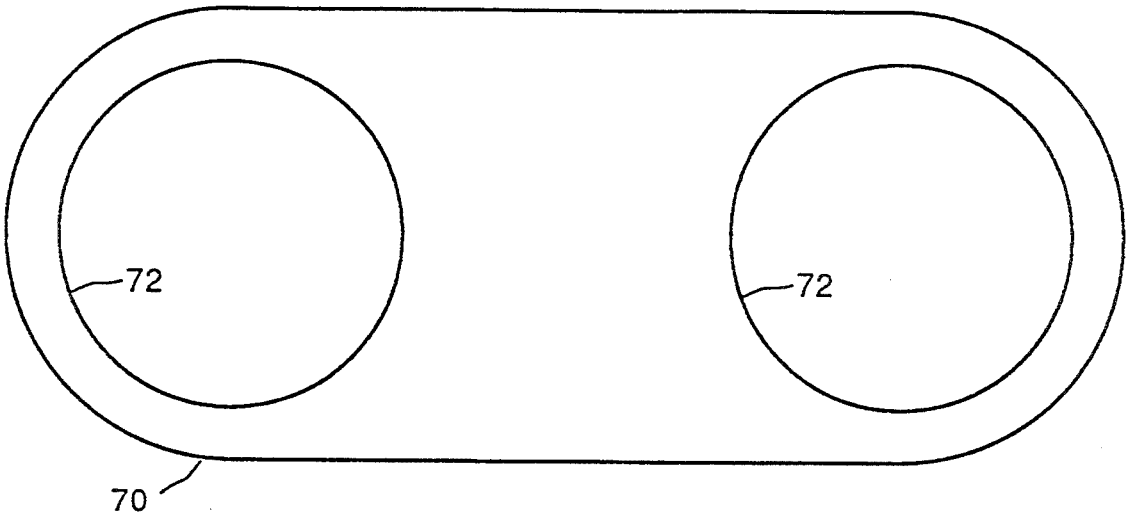
FIG. 4 is a top plan view of a linking member for retaining a plurality of insulated modular vessels in side-by-side relation.

FIG. 4 shows a linking member 70 having a pair of apertures 72 therein and that is thereby able to receive and retain two main body portions 30 therein, and therefore link two insulated modular vessels 20 one to the other in side-by-side relation. In this manner, a double insulated modular vessel 20 capable of containing twelve cans 22 could be formed. It is also possible to connect sets of mated main body portions 30 to one another in side-by-side relation to form a multiple insulated modular vessel 20. For instance, sets of three main body portions 30 could be mated one to another in end-to-end relation, as shown in FIGS. 2 and 3, and three or more of these sets of three mated main body portions 30 could be linked by way of a plurality of linking members 70. It is also possible to have appropriately sized and shaped linking members with three or four, or even more, apertures 72 therein.

It is also contemplated that in one alternative embodiment, the main body portion 30 could be sized to contain only one can 22 so as to provide for maximum flexibility in terms of retaining any number of cans 22 without wasted space. In this manner, it is possible to have the main body portion 30 sized so as to have a single can 22 protrude from the top thereof when a second end cap 62 is in place on the second end 34 of the main body portion 30. This partial insulated modular vessel 20 containing the single can 22 is thereby usable for retaining the can 22 while consuming the beverage therefrom.

Figure 5:
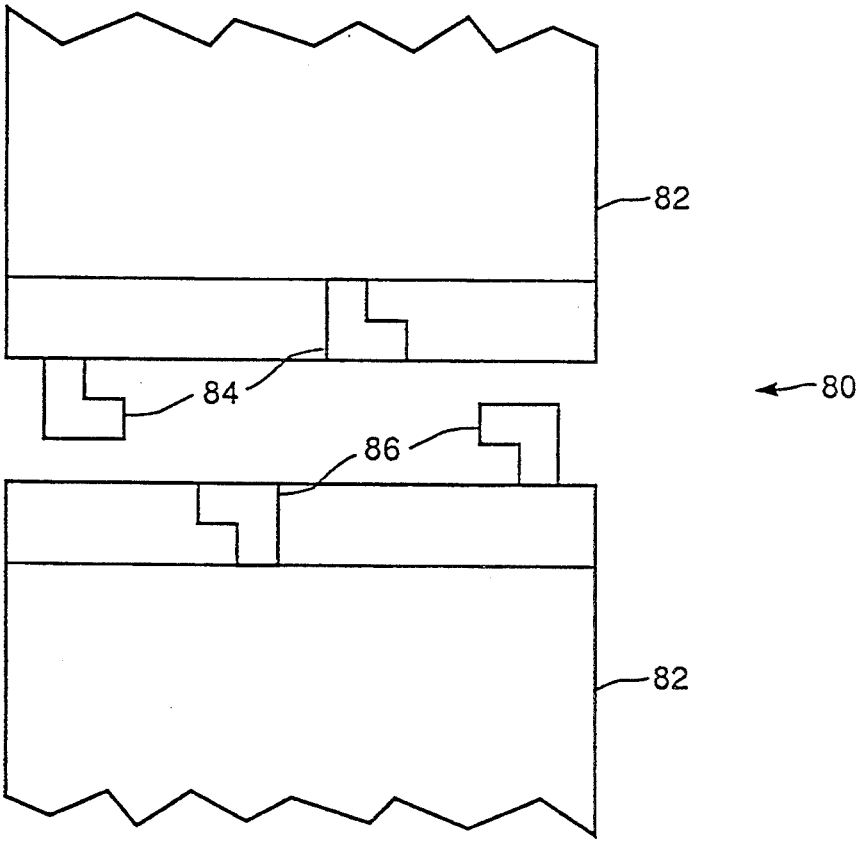
FIG. 5 is a partial side elevational view of an alternative embodiment of the present invention, wherein identical first and second ends on two main body portions are about to be mated one to the other.

In a further alternative embodiment, as shown in FIG. 5, it is contemplated that an insulated modular vessel 80 is formed by way of mating two main body portions 82 having first and second matable interconnection components 84,86 which are identical one to the other, thus making the main body portions 82 longitudinally symmetrical.

Figure 6:
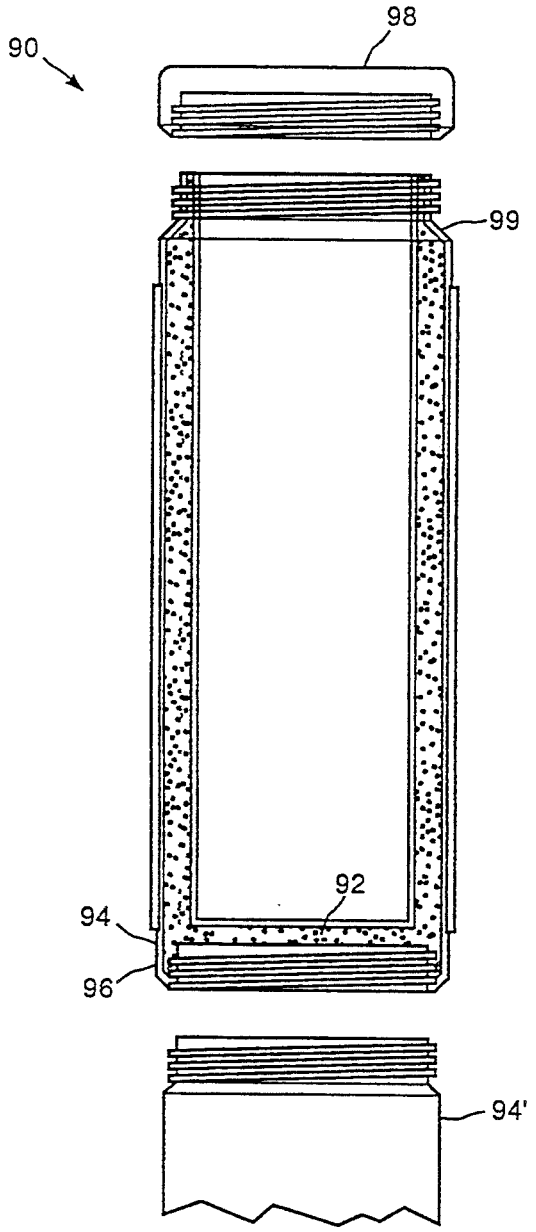
FIG. 6 is an exploded diagrammatic side elevational view of an alternative embodiment of the insulated modular vessel of the present invention, wherein the main body portion has a fixed end closure.

In another alternative embodiment, as shown in FIG. 6, it is envisioned to have an insulated modular vessel 90 wherein there is a second end closure 92 permanently attached to the main body portion 94, preferably formed as an integral part thereof, at the second end 96. The second end closure 92 precludes the passage of cans into and out of the modular vessel 90 through the second end 96. This embodiment of the insulated modular vessel 90 of the present invention is particularly adapted to be sized so as to contain one can only, such that the can protrudes from the top thereof, and in this manner the insulated modular vessel 90 is usable for holding a single can and consuming the beverage therefrom. In use, the first end cap 98 would be removed from the first end 99 of the uppermost main body portion 94. The uppermost main body portion 94 would be removed for the purposes of drinking from, and the first end cap 98 would be placed onto the first end 99' of the next main body portion 94', which has been left open-ended by the removal of the uppermost main body portion 94. After the beverage in the can retained by the single removed main body portion 94 has been consumed, the first end 99 of the main body portion 94 would be mated with the second end 96 of the main body portion 94 (not shown) at the opposite other end of the insulated modular vessel 90. In this manner, the cans are kept cold during transportation, are kept cold during consumption, and are then returned to the insulated modular vessel 90, so that it is not necessary to immediately dispose of the empty cans. It is possible to make the main body portion 94 (not shown) that is initially at the bottom of the insulated modular vessel 90, so as to thereby provide an indicator that divides the full cans from the empty cans.

Figure 7:
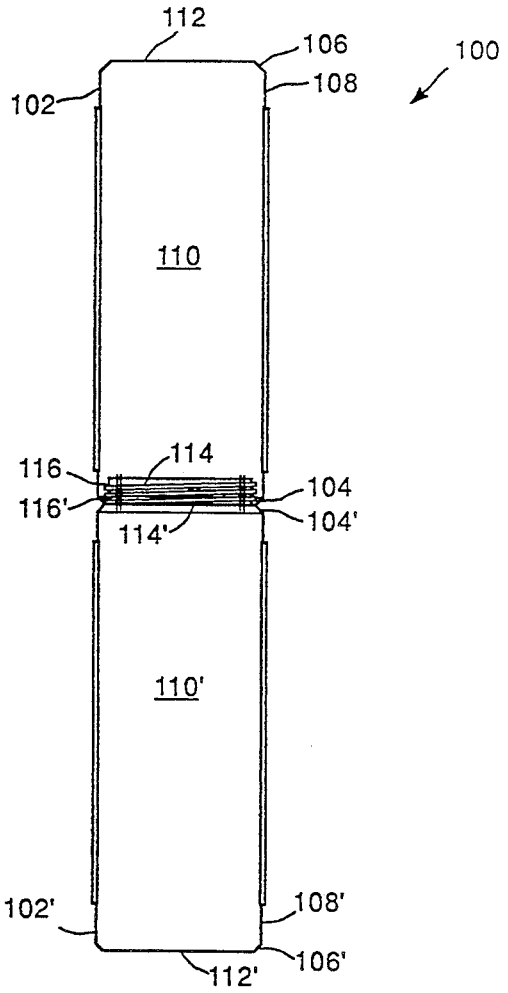
FIG. 7 is a side elevational view of another alternative embodiment of the insulated modular vessel of the present invention.

In yet another alternative embodiment, as shown in FIG. 7, the insulated modular vessel 100 has two main body portions 102,102', with each of the two main body portions 102,102' being of a size and shape to retain any convenient number of cans. Each of the two main body portions 102,102' has a first end 104,104', a second end 106,106', a peripherally disposed outer wall 108,108' extending between the first end 104,104' and the second end 106,106' so as to define a centrally disposed cavity 110,110' that is shaped and dimensioned to receive and retain the aforesaid cans. At the second end 106,106' of each of the two main body portions 102,102' is a second end closure 112,112' attached thereto, preferably formed as an integral part of the main body portion 102,102', so as to preclude the passage of cans into and out of the modular vessel 100. Further, each main body portion 102,102' has a first opening 114,114' at the first end 104,104' thereof with the first opening 114,114' being shaped and dimensioned to permit the passage of cans into and out of the centrally disposed cavity 110,110'. Disposed one each at the first ends 104,104' of the main body portions 102,102' are first and second matable interconnection components 116,116'. By way of these first and second matable interconnection components 116,116', the two main body portions 102,102' are removably matably attachable to each other in first-end-to-first-end relation so as to form the insulated modular vessel 100. The modular vessel 100 is closed off at its second ends 106,106' by the two second end closures 112,112'. It is also contemplated that the first and second interconnection components 116,116' are substantially identical to each other, as shown in FIG. 5, so as to have the two main body portions 102,102' be identical to each other.

Other modifications and alterations may be used in the design and manufacture of the mechanical security apparatus of the present invention without departing from the spirit and scope of the accompanying claims.

What is claimed is:

1. An insulated modular vessel for transporting beverage containers that are of a known size and shape, said modular vessel comprising:

at least one main body portion having a first end, a second end, and a peripherally disposed outer wall extending between said first and second ends and defining a centrally disposed cavity shaped and dimensioned to receive and retain at least one of said beverage containers therein;

first and second openings in said main body portion at said first and second ends thereof respectively, said first and second openings each shaped and dimensioned to permit the passage of said at least one beverage container therethrough, into and out of said centrally disposed cavity;

first and second matable interconnection components disposed at said first and second ends respectively of said main body portion such that a plurality of said main body portions are removably matably attachable one to another in first end to second end relation so as to form said modular vessel; and first and second end caps each having one of said second and first interconnection components thereon respectively, so as to be removably matably attachable to said first and second interconnection components respectively to thereby close off the open ends of said formed modular vessel.

2. The insulated modular vessel of claim 1, wherein said second end cap is removably attached to said main body portion at said second end thereof so as to selectively preclude the passage of said beverage containers into and out of said modular vessel.

3. The insulated modular vessel of claim 1, further comprising supplementary thermal insulation means operatively retained by said vessel so as to be disposed generally around the perimeter thereof.

4. The insulated modular vessel of claim 1, wherein said peripherally disposed outer wall is generally cylindrically shaped.

5. The insulated modular vessel of claim 1, wherein each said main body portion is sized to contain one beverage container.

6. The insulated modular vessel of claim 5, wherein said main body portion is dimensioned so as to have a single one of said beverage containers protrude from the top thereof when said second end cap is in place on said second end of said single one of said beverage containers so as to be useable for holding said single one of said beverage containers and consuming the beverage therefrom.

7. The insulated modular vessel of claim 1, wherein each said main body portion is sized to contain two beverage containers.

8. The insulated modular vessel of claim 1, wherein said first interconnection component comprises a male thread and said second interconnection component comprises a female thread, said male and female threads being co-operable with one another.

9. The insulated modular vessel of claim 1, wherein said first and second matable interconnection components are identical one to the other.

10. The insulated modular vessel of claim 1, wherein said main body portions are connectable one to another in side-by-side relation.

11. The insulated modular vessel of claim 1, further comprising a linking member adapted to receive and retain a plurality of insulated modular vessels in side-by-side relation.

12. An insulated modular vessel for transporting beverage containers that are of a known size and shape, said modular vessel comprising:

at least one main body portion having a first end, a second end, and a peripherally disposed outer wall extending between said first and second ends and defining a centrally disposed cavity shaped and dimensioned to receive and retain a least one of said beverage containers therein;

a first opening in said main body portion at said first end thereof, said first opening shaped and dimensioned to permit the passage of said at least one beverage container into and out of said centrally disposed cavity;

a second end closure attached to said main body portion at said second end thereof so as to preclude the passage of said beverage containers into and out of said modular vessel;

first and second matable interconnection components disposed at said first and second ends respectively of said main body portion such that a plurality of said main body portions are removably matably attachable one to another in first end to second end relation so as to form said modular vessel; and a first end cap having said second interconnection component thereon, so as to be removably matably attachable to said first interconnection component to thereby close off the open end of said formed modular vessel.

13. The insulated modular vessel of claim 12, wherein each said main body portion is sized to contain one beverage container.

14. The insulated modular vessel of claim 13, wherein said main body portion is dimensioned so as to have a single one of said beverage containers protrude from the top thereof so as to be useable for holding said single one of said beverage containers and consuming the beverage therefrom.

15. An insulated modular vessel for transporting beverage containers that are of a known size and shape, said modular vessel comprising:

two main body portions each having a first end, a second end, and a peripherally disposed outer wall extending between said first and second ends and defining a centrally disposed cavity shaped and dimensioned to receive and retain a least one of said beverage containers therein;

a first opening in said main body portion at said first end thereof, said first opening shaped and dimensioned to permit the passage of said at least one beverage container into and out of said centrally disposed cavity;

a second end closure attached to said main body portion at said second end thereof so as to preclude the passage of said beverage containers into and out of said modular vessel; and first and second matable interconnection components disposed at said first ends respectively of said main body portion such that said two main body portions are removably matably attachable to each other in first end to first end relation so as to form said modular vessel, and whereby said modular vessel is closed off by the two of said second end closures.

16. The insulated modular vessel of claim 15, wherein said first and second interconnection components are substantially identical to each other.

* * * * *